US007235928B2

(12) United States Patent
Shiokawa et al.

(10) Patent No.: US 7,235,928 B2
(45) Date of Patent: Jun. 26, 2007

(54) GAS DISCHARGE PANEL AND MANUFACTURING METHOD FOR THE SAME

(75) Inventors: Akira Shiokawa, Osaka (JP); Koji Akiyama, Neyagawa (JP); Tetsuya Imai, Kadoma (JP); Katsutoshi Shindo, Higashiosaka (JP); Hidetaka Higashino, Souraku-gun (JP); Koichi Kotera, Osaka (JP); Kanako Miyashita, Mishima-gun (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 492 days.

(21) Appl. No.: 10/472,406

(22) PCT Filed: May 31, 2002

(86) PCT No.: PCT/JP02/05327

§ 371 (c)(1),
(2), (4) Date: Apr. 5, 2004

(87) PCT Pub. No.: WO02/099833

PCT Pub. Date: Dec. 12, 2002

(65) Prior Publication Data

US 2004/0150337 A1 Aug. 5, 2004

(30) Foreign Application Priority Data

Jun. 1, 2001 (JP) ..... 2001-166582
Jun. 1, 2001 (JP) ..... 2001-166589

(51) Int. Cl.
*H01J 17/20* (2006.01)

(52) U.S. Cl. ..... 313/637; 313/582

(58) Field of Classification Search ..... 313/582–587
See application file for complete search history.

(56) References Cited

U.S. PATENT DOCUMENTS 3,778,126 A 12/1973 Wilson (Continued)

FOREIGN PATENT DOCUMENTS

EP 0 779 643 A2 12/1996

(Continued)

OTHER PUBLICATIONS

Ahern et al., Effect of Reactive Gas Dopants on the MgO Surface in AC Plasma Display Panels, Nov. 1978, IBM J. Res. Develop., vol. 22, No. 6.

*Primary Examiner*—Nimeshkumar D. Patel
*Assistant Examiner*—Matt Hodges

(57) ABSTRACT

A gas discharge panel capable of high-speed driving at a low drive voltage, while suppressing the occurrence of write errors in a write period, and a manufacturing method for the same. To achieve this, in the gas discharge panel of the present invention, a secondary gas formed from at least one of carbon dioxide, water vapor, oxygen and nitrogen is induced into discharge spaces 30 evacuated until the residual gas pressure is 0.02 mPa or less, and an He—Xe or Ne—Xe rare gas (discharge gas) is induced into discharge spaces 30. The amount of the secondary gas included within discharge spaces 30 when, for example, carbon dioxide is included therein, is suitably set in terms of both a discharge starting voltage and an electron emission ability, so that the partial pressure of the carbon dioxide is in a range of 0.05 mPa to 0.5 mPa inclusive.

23 Claims, 12 Drawing Sheets

U.S. PATENT DOCUMENTS

| | | | | |
|---|---|---|---|---|
| 4,024,613 | A | 5/1977 | Martel et al. | |
| 5,385,499 | A | 1/1995 | Ogawa et al. | |
| 5,528,109 | A * | 6/1996 | Ilcisin et al. | 315/169.4 |
| 5,742,122 | A | 4/1998 | Amemiya et al. | |
| 5,747,931 | A | 5/1998 | Riddle et al. | |
| 5,770,921 | A | 6/1998 | Aoki et al. | |
| 5,892,492 | A | 4/1999 | Osawa et al. | |
| 5,976,236 | A * | 11/1999 | Yoshihara et al. | 106/286.6 |
| 5,990,617 | A | 11/1999 | Kanae et al. | |
| 6,177,762 | B1 * | 1/2001 | Nakayama | 313/582 |
| 6,472,819 | B2 | 10/2002 | Carretti et al. | |
| 6,744,208 | B2 * | 6/2004 | Kado et al. | 313/637 |

FOREIGN PATENT DOCUMENTS

| | | | |
|---|---|---|---|
| EP | 0 779 643 | A3 | 12/1996 |
| FR | 2 696 867 | | 10/1993 |
| JP | 52073672 | A | 6/1977 |
| JP | 60107233 | A | 6/1985 |
| JP | 63155528 | A | 6/1988 |
| JP | 01065743 | A | 3/1989 |
| JP | 01175146 | A | 7/1989 |
| JP | 01183029 | A | 7/1989 |
| JP | 3-25826 | | 2/1991 |
| JP | 3-77233 | | 4/1991 |
| JP | 03233829 | A | 10/1991 |
| JP | 04079126 | A | 3/1992 |
| JP | 04095331 | A | 3/1992 |
| JP | 5-205640 | | 8/1993 |
| JP | 06231731 | | 8/1994 |
| JP | 08095239 | A | 4/1996 |
| JP | 08250030 | A | 9/1996 |
| JP | 09245653 | A | 9/1997 |
| JP | 10149773 | A | 6/1998 |
| JP | 10208648 | A | 8/1998 |
| JP | 10302645 | A | 11/1998 |
| JP | 11120920 | A | 4/1999 |
| JP | 11185628 | A | 7/1999 |
| JP | 2001135237 | A | 5/2001 |
| JP | 2001210237 | A | 8/2001 |
| JP | 2001222957 | A | 8/2001 |

* cited by examiner

CHANGE IN CHARACTERISTICS DUE TO CHANGE IN WATER VAPOR/CARBON DIOXIDE PARTIAL PRESSURE (ELECTRON EMISSION ABILITY)

CHANGE IN CHARACTERISTICS DUE TO CHANGE IN WATER VAPOR/CARBON DIOXIDE PARTIAL PRESSURE (DISCHARGE STARTING VOLTAGE)

DISPLAY ERROR RATE AT DIFFERENT TEMPERATURES

GAS DISCHARGE PANEL AND MANUFACTURING METHOD FOR THE SAME

TECHNICAL FIELD

The present invention relates to a gas discharge panel used in display devices and the like, and a manufacturing method for the same.

BACKGROUND ART

In recent years, gas discharge panels, and in particular plasma display panels (PDP), have become widely used a display devices.

PDPs are divided broadly into direct current (DC-type) and alternating current (AC-type), although presently the AC-type, which can adopt a minute cell structure and is suited to high-definition image display, is more prevalent.

An AC-type PDP is structured so that a front panel and a back panel are disposed parallel to and facing each other with a gap therebetween, the panels being sealed together around an outer periphery.

The front panel is structured with display electrodes arranged in a stripe pattern on one main surface of a front glass substrate, a dielectric glass layer covering the display electrodes, and a dielectric protective film (MgO) covering the dielectric glass layer.

On the other hand, the back panel is structured with data electrodes arranged in a stripe pattern on one main surface of a back glass substrate, a dielectric glass layer covering the data electrodes, and barrier ribs provided on the dielectric glass layer in a direction parallel with the data electrodes. Also, red (R), green (G) and blue (B) phosphor layers are formed on the side and bottom surfaces of grooves formed by the dielectric glass layer and the barrier ribs.

The gap between the front panel and the back panel is a discharge space, and this discharge space is filled with a primary gas (rare gas) that acts as a discharge gas. Characteristics demanded of the rare gas include allowing for the radiation of strong ultraviolet rays, the reduction of self-absorption, the reduction of visible light emission, and chemical stability. A mixed gas (Ne—Xe, He—Xe, etc.) and the like having a xenon (Xe) base is generally used in panels as a rare gas that satisfies these conditions. After sealing both panels together around an outer periphery, the discharge space, which has been evacuated to 0.1 mPa, is filled at a required pressure (e.g. 40 kPa to 80 kPa inclusive) with the mixed gas.

In an AC-type PDP having the above structure, each discharge cell can only express the two gradations of on/off. Thus, to display an image in a PDP, an intraframe time-division gradation display method is used, in which a single frame (one field) is divided into a plurality of frames (subfields), and intermediate gradations are expressed by varying the combinations of on/off discharge cells in each subfield. Also, with an AC-type PDP, discharge cells are turned on/off in each subfield using wall charge. Technology relating to this is disclosed, for example, in Japanese patent no. 2756053.

In Japanese patent no. 2756053, the subfields each have (i) a write period in which a write pulse having a selective write voltage lower than a discharge starting voltage is applied between an address electrode (data electrode) and a scan electrode which cross over one another in a pixel to be turned on, thus generating a write discharge for making the pixel emit discharge light, and wall charge as a result of the write discharge, and (ii) a sustain-discharge period in which the pixel selectively written in the write period is made to emit discharge light by applying a sustain pulse having opposite polarity to the wall charge generated by the write discharge and a lower voltage than the discharge starting voltage between the sustain electrodes (as common electrodes X) and all of the scan electrodes (Y1-Yn).

That is, discharge cells in which wall charge has been generated as a result of the write discharge in the write period emit light as a result of the sustain pulse applied in the sustain-discharge period.

However, with the above AC-type PDP, a variety of investigations are being conducted into shortening the write period, with the aim of achieving the high driving speeds that enable lower voltages and higher definition.

In an attempt to solve this problem, improving the characteristics of the dielectric protective film in the front panel of an AC-type PDP, for example, allows electrons to be readily emitted from the film surface, even when an electric field is not applied to the dielectric protective film; that is, the dielectric protective film is made to have a high electron emission ability. A dielectric protective film having a high electron emission ability is necessary for generating gas discharges within discharge cells, and allows for the presence of a large number of initial electrons.

Consequently, with an AC-type PDP having the above dielectric protective film, it is possible to shorten the discharge delay time of write discharges in the write period, and high-speed driving thus becomes possible.

However, when attempts are made to shorten the discharge delay time of the write discharge in the write period of an AC-type PDP, the negative absolute value of the potential of the dielectric protective film surface is reduced as a result of electrons being emitted from the dielectric protective film surface, in the event of electrons, which are charged particles, having accumulated on the film surface as wall charge. That is, the potential of the dielectric protective film surface changes electrically in a positive direction. As a result, the tendency in the above discharge cells is for the absolute amount of negative charge in the wall charge to decrease.

Consequently, even if a sustain pulse is applied to the electrodes in the sustain-discharge period, write errors occur in which discharge cells are not turned on because of the aggregate of wall charge and sustain pulse potential not being able to exceed the discharge starting voltage due to the reduction in wall charge.

DISCLOSURE OF THE INVENTION

The present invention aims to provide a gas discharge panel drivable at high speeds using a low drive voltage, while suppressing the occurrence of write errors in a write period, and a manufacturing method for the same.

In the process of research aimed at resolving the above issues, the inventor of the present invention identified that a relationship exists between the occurrence of write errors and substances other than a primary gas (rare gas) present within the discharge space. Specifically, in comparison with the prior art, in which the smaller the amount of substances present in the discharge space other than rare gas the better, the inventor identified that the presence of a required amount of specific types of gas with the rare gas in the discharge space reduced the likelihood of write errors occurring more than when only rare gas was present, even when the panel was driven at high speeds using a low drive voltage.

A gas discharge panel of the present invention has two substrates disposed so as to face each other with a discharge space filled with a primary gas therebetween, and is characterized by having secondary gases such as those listed below present within the discharge space.

(1-1) carbon dioxide having a partial pressure of 0.05 mPa to 5 mPa inclusive (1-2) carbon dioxide having a partial pressure of 0.05 mPa to 0.5 mPa inclusive (1-3) carbon dioxide having a partial pressure of 0.1 mPa to 0.2 mPa inclusive (1-4) carbon dioxide having a partial pressure of 1 mPa to 5 mPa inclusive (1-5) carbon dioxide having a partial pressure of 1.5 mPa to 3 mPa inclusive (1-6) water vapor having a partial pressure of 1 mPa to 10 mPa inclusive (1-7) water vapor having a partial pressure of 2 mPa to 5 mPa inclusive (1-8) oxygen having a partial pressure of 0.3 mPa to 5 mPa inclusive (1-9) oxygen having a partial pressure of 1 mPa to 3 mPa inclusive (1-10) carbon dioxide having a partial pressure of 0.5 mPa to 1 mPa inclusive and oxygen having a partial pressure of 1 mPa to 5 mPa inclusive (1-11) carbon dioxide having a partial pressure of 0.5 mPa to 1 mPa inclusive and oxygen having a partial pressure of 2 mPa to 3 mPa inclusive (1-12) water vapor having a partial pressure of 5 mPa to 20 mPa inclusive and nitrogen having a partial pressure of 1 Pa to 6 Pa inclusive (1-13) water vapor having a partial pressure of 2 mPa to 10 mPa inclusive and nitrogen having a partial pressure of 2 Pa to 3 Pa inclusive (1-14) water vapor having a partial pressure of 1 mPa to 10 mPa inclusive and carbon dioxide having a partial pressure of 0.05 mPa to 0.5 mPa inclusive (1-15) water vapor having a partial pressure of 1 mPa to 8 mPa inclusive and carbon dioxide having a partial pressure of 0.1 mPa to 0.5 mPa inclusive (1-16) water vapor having a partial pressure of 2 mPa to 5 mPa inclusive and carbon dioxide having a partial pressure of 0.1 mPa to 0.2 mPa inclusive (1-17) water vapor having a partial pressure of 5 mPa to 20 mPa inclusive and oxygen having a partial pressure of 0.2 mPa to 2 mPa inclusive (1-18) water vapor having a partial pressure of 5 mPa to 10 mPa inclusive and oxygen having a partial pressure of 0.5 mPa to 1.5 mPa inclusive In a gas discharge panel having the above impurities (1-1) to (1-18) present in the discharge space, the discharge starting voltage is low, and the electron emission ability is optimized. As a result, with a gas discharge panel such as this, the occurrence of write errors in the write period when the panel is driven is suppressed, and reducing drive voltages and increasing drive speeds is made possible.

Mechanisms that allow a gas discharge panel of the present invention to have the above superior qualities have been proven experimentally although not conclusively. This area will be referred to later.

Here, "partial pressure" in the present description refers to a partial pressure obtained when gas analysis is conducted at room temperature and under conditions in which the panel is not being discharged.

The above superior qualities are, in particular, clearly expressed by a gas discharge panel having an area in which a statistical delay time within the discharge delay time when the panel is driven is no more than 100 nsecs.

Here, a "statistical delay time" is defined by a time period obtained as follows. A Laue plot is produced of a luminescence start time of a luminescence waveform as the origin of a fall timing of an applied voltage of the write discharge, when only a single cell and a single subfield are irradiated using a single color, and the brightness weight of the irradiated subfield is 25 to 40 gradations out of 256 8-bit gradations. The statistical delay time obtained in this case is defined as the statistical delay time in the present description. The absolute value of this statistical delay time varies depending on related conditions.

Also, the superior qualities of the above gas discharge panel are particularly evident when the MgO forming the dielectric protective film in the front panel of the two panels has a weight density of 70% to 85% inclusive with respect to single crystal weight density. Moreover, the MgO forming the dielectric protective film most preferably has a weight density of 70% to 80% inclusive with respect to single crystal weight density.

With a gas discharge display device having the above gas discharge panel and a drive circuit, it is possible to obtain the superior qualities of the gas discharge panel mentioned above, without alteration.

Next, a manufacturing method for a gas discharge panel of the present invention is characterized by disposing two substrates with a discharge space therebetween (substrate disposing step), exhausting residual gas with respect to this discharge space (exhausting step), inducing a secondary gas formed from at least one selected from carbon dioxide, water vapor, oxygen and nitrogen into the discharge space after the exhausting step (secondary gas inducing step), and then inducing a primary gas (primary gas inducing step).

According to a manufacturing method such as this, it is possible to include a required amount of a secondary gas, being at least one selected from carbon dioxide, water vapor, oxygen and nitrogen, in the discharge space.

Consequently, with this manufacturing method, it is possible to manufacture a gas discharge panel in which the occurrence of write errors in the write period when the panel is driven are suppressed, and that is capable of being driven at high speeds using a low drive voltage.

Also, it is possible to obtain the same effects as the above manufacturing method, even when a gas discharge panel of the present invention is manufactured by conducting the steps of disposing two substrates with a discharge space therebetween (substrate disposing step), conducting exhausting with respect to the discharge space after the discharge space forming step, until the residual amount of carbon dioxide is 0.05 mPa to 0.5 mPa inclusive (exhausting step), and, after the exhausting step, inducing a primary gas with respect to the discharge space (primary gas inducing step).

In the above manufacturing methods, the one or more types of gas (secondary gas) that are induced into or allowed to remain within the discharge space are shown by the following (2-1) to (2-9).

(2-1) carbon dioxide having a partial pressure of 0.05 mPa to 5 mPa inclusive after the primary gas has been induced (2-2) carbon dioxide having a partial pressure of 0.05 mPa to 0.5 mPa inclusive after the primary gas has been induced (2-3) carbon dioxide having a partial pressure of 1 mPa to 5 mPa inclusive after the primary gas has been induced (2-4) water vapor having a partial pressure of 1 mPa to 10 mPa inclusive after the primary gas has been induced (2-5) oxygen having a partial pressure of 0.3 mPa to 5 mPa inclusive after the primary gas has been induced (2-6) carbon dioxide having a partial pressure of 0.5 mPa to 1 mPa inclusive and oxygen having a partial pressure of 1 mPa to 5 mPa inclusive after the primary gas has been induced (2-7) water vapor having a partial pressure of 5 mPa to 20 mPa inclusive and nitrogen having a partial pressure of 1 Pa to 6 Pa inclusive after the primary gas has been induced (2-8) water vapor having a partial pressure of 1 mPa to 10 mPa inclusive and carbon dioxide having a partial pressure of 0.05 mPa to 0.5 mPa inclusive after the primary gas has been induced (2-9) water vapor having a partial pressure of 5 mPa to 20 mPa inclusive and oxygen having a partial pressure of 0.2 mPa to 2 mPa inclusive after the primary gas has been induced When a dielectric protective film in the above gas discharge panel is formed by oblique evaporation, gas discharge panels manufactured using the above manufacturing methods exhibit particularly excellent characteristics.

BEST MODE FOR CARRYING OUT THE INVENTION

1. Overall Structure of Panel

Figure 1:
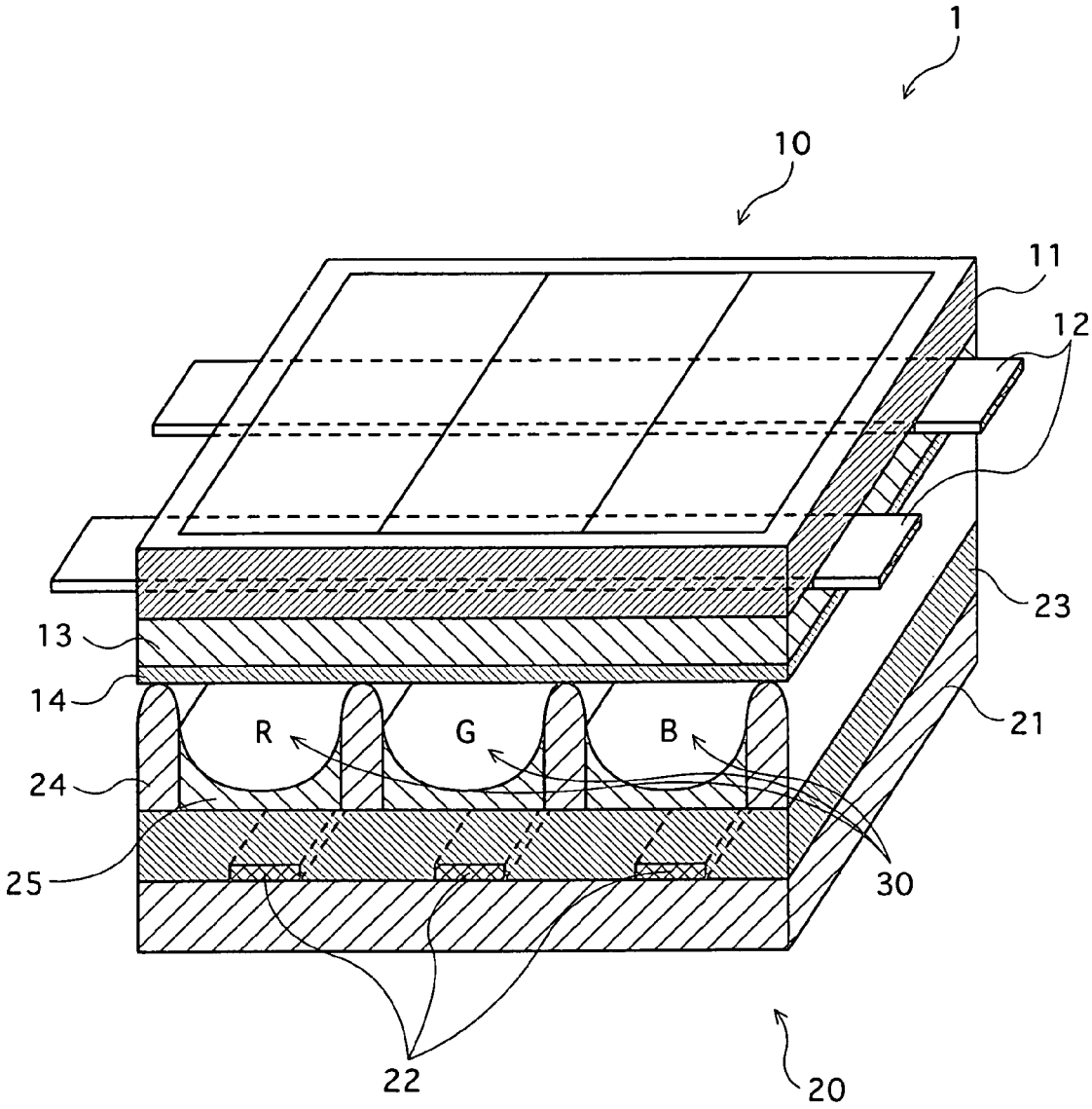
FIG. 1 is a perspective diagram (partial cross-section) of a PDP 1 pertaining to an embodiment of the present invention.

An AC-type PDP 1 (hereafter simply "PDP 1") pertaining to the present invention is described using FIG. 1. FIG. 1 is a perspective diagram (partial cross-section) of PDP 1, and focuses on a section of a display area in the panel.

As shown in FIG. 1, PDP 1 is structured with a front panel 10 and a back panel 20 disposed facing each other with a gap therebetween. Also, the gap between front panel 10 and back panel 20 is partitioned into a plurality of discharge spaces 30 by plural lines of barrier ribs 24 provided on a main surface of back panel 20.

In front panel 10, a plurality of display electrodes 12, whose main component is Ag, is arranged in a stripe pattern on one of the main surfaces of a front glass substrate 11, and the surface of front glass substrate 11 on which the display electrodes 12 are arranged is covered by a dielectric glass layer 13 made from a lead low-melting glass. Furthermore, a dielectric protective film 14 made from MgO is formed on a surface of dielectric glass layer 13.

Of the elements structuring front panel 10, dielectric protective film 14 is here formed by evaporating MgO. Dielectric protective film 14 preferably has characteristics that allow for shortening the discharge delay time in PDP 1 and for improving the electron emission ability. A formation method for dielectric protective film 14 is described later.

Here, forming dielectric protective film 14 by oblique evaporating MgO is suitable for shortening the discharge delay time in PDP 1 and improving the electron emission ability.

Also, dielectric protective film 14 formed by MgO having a comparatively low weight density of 70% to 85% inclusive of a single crystal material also has a large surface area per volume and a high electron emission ability. Furthermore, it is most preferable, in terms of the above characteristics, if the weight density of the MgO forming the dielectric protective film 14 is 70% to 80% inclusive of a single crystal material.

Consequently, dielectric protective film 14 preferably is formed by oblique evaporating MgO, and furthermore, the weight density of the MgO forming dielectric protective film 14 preferably is 70% to 85% inclusive, or more preferably 70% to 80% inclusive, of a single crystal material.

On the other hand, in back panel 20, a plurality of data electrodes is arranged in a stripe pattern on the surface of a back glass substrate 21 facing front panel 10, and the surface of back glass substrate 21 on which data electrodes 22 are arranged is covered by a dielectric glass layer 23 that includes $TiO_2$. Furthermore, barrier ribs 24 are provided on a surface of dielectric glass layer 23 in a direction parallel with data electrodes 22, so as to be positioned between adjacent data electrodes 22. Phosphor layers 25 of the colors red (R), green (G) and blue (B) are formed, one per groove, on an inner wall surface of grooves formed by dielectric glass layer 23 and barrier ribs 24. Phosphor materials used in forming phosphor layers 25 are excitation luminescence type materials.

Front panel 10 and back panel 20 are disposed so that display electrodes 12 formed on the former are orthogonal to data electrodes 22 formed on the latter, and an airtight sealing layer (frit glass) is used to seal an outer periphery of the panels (not depicted).

Discharge spaces 30 are encompassed by dielectric protective film 14 of front panel 10, and phosphor layers 25 and barrier ribs 24 of back panel 20. An Ne—Xe or He—Xe gas (rare gas) is enclosed as a primary gas in discharge spaces 30. Discharge spaces 30 are, apart from this, filled with a secondary gas, a description of which is given later.

With PDP 1, sections where display electrodes 12 and data electrodes 22 face each other in discharge spaces 30, when viewed from outside of front panel 10, equate to luminescence cells.

2. Structure of PDP Display Device

Figure 2:
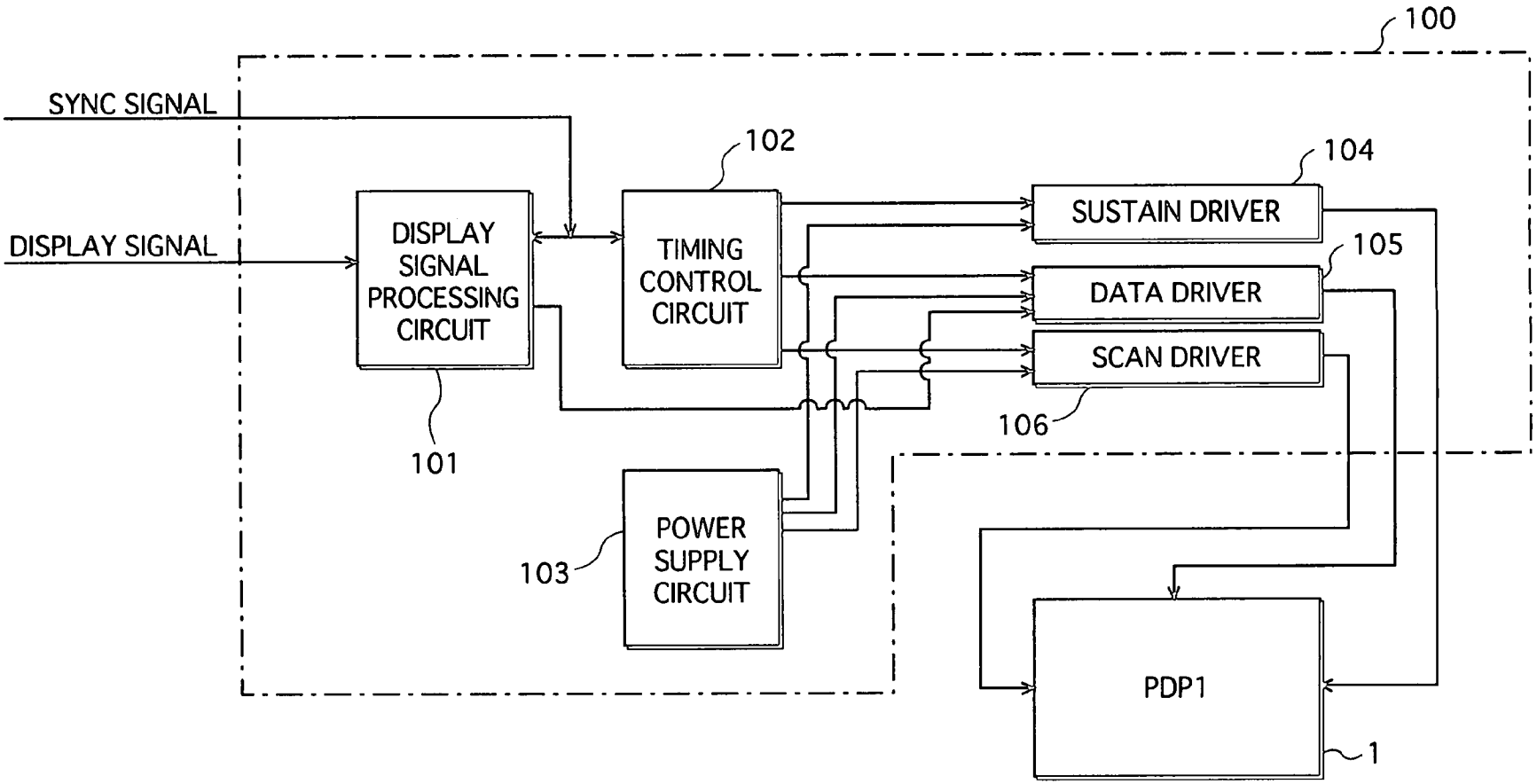
FIG. 2 is a block diagram showing an overall structure of a PDP display device.

Next, an overall structure of a PDP display device that includes PDP 1 is described using FIG. 2.

As shown in FIG. 2, the PDP display device is structured from the above PDP 1 and a drive circuit 100.

In drive circuit 100 is included a display signal processing circuit 101, a timing control circuit 102, a power supply circuit 103, a sustain driver 104, a data driver 105, and a scan driver 106.

Display signal processing circuit 101 extracts a display signal (field display signal) per field from a display signal inputted from an external video outputter, creates a display signal (subfield display signal) of each subfield from the extracted field display signal, and stores the created display signal in an internal frame memory.

Also, display signal processing circuit 101 outputs a display signal per line to data driver 105 from a current subfield display signal stored in the frame memory, detects a synchronous (sync) signal, which is a horizontal sync signal, a vertical sync signal or the like, from the inputted display signal, and sends the sync signal to timing control circuit 102 per field or per subfield.

The above frame memory is a dual-port frame memory that includes two 1-field memory areas (storing 8 subfield display signals) per field, and that alternately conducts operations to write a field display signal into one memory area, while reading a written field display signal out of the other memory area.

Timing control circuit 102 generates trigger signals instructing a timing at which to generate the various pulses per field or per subfield, and outputs the generated trigger signal to drivers 104, 105 and 106.

Sustain driver 104 has a sustain pulse generator and an erase pulse generator, and, based on the trigger signal sent from timing control circuit 102, generates a sustain pulse and an erase pulse and applies the generated pulses to a sustain electrode group.

Scan driver 106 has an initialization pulse generator and a scan pulse generator, and, based on the trigger signal sent from timing control circuit 102, generates an initialization pulse and an scan pulse and applies the generated pulses to a scan electrode group of PDP 1.

The power supply circuit supplies drive voltages to drivers 104, 105 and 106.

In a PDP display device having a structure such as the above, the subfields are each structured from a consecutive sequence consisting of an initialization period, a write period, a sustain-discharge period and an erase period.

In the initialization period, an initialization pulse is applied to the scan electrode group within display electrodes 12 to initialize a charged state of all of the discharge cells.

In the write period, a data pulse is applied to electrodes selected from among data electrodes 22, while a scan pulse is sequentially applied to the scan electrodes. Wall charge accumulates and image information is written in discharge cells that contain electrodes applied with the data pulse.

In the sustain-discharge period, a sustain pulse having a voltage that is lower than a discharge starting voltage and the same polarity as wall charge generated by the write discharge, is applied between the sustain electrodes (as common electrodes X) and all of the scan electrodes (Y1-Yn) included in display electrodes 12, to create a discharge in discharge cells in which wall charge accumulation was conducted in the write period, thus illuminating these discharge cells for a predetermined period of time.

In the erase period, erasure of wall charge in discharge cells is conducted by collectively applying a narrow erase pulse to the scan electrode group.

That is, with PDP 1, discharge cells in which wall charge has been generated by the write discharge in the write period emit light upon being applied with the sustain pulse.

3. Composition of Gas Filling Discharge Spaces

Next, the composition of a gas that fills the discharge spaces is described, this being a characteristic part of the present embodiment.

Discharge spaces 30 of PDP 1 are filled at a required amount with carbon dioxide as a secondary gas in addition to a rare gas such as an Ne—Xe gas, an He—Xe gas or the like. The partial pressure of carbon dioxide in the discharge spaces is set in a range of 0.05 mPa to 5 mPa inclusive. In particular, the carbon dioxide partial pressure preferably is set in a range of 0.05 mPa to 0.5 mPa inclusive. "Partial pressure" referred to here is a partial pressure obtained when gas analysis is performed at room temperature and with the panel in a non-discharge state.

4. Manufacturing Method for PDP 1

4-1. Manufacture of Front Panel

In manufacturing front panel 10, firstly display electrodes 12 are formed on front glass substrate 11 by applying a silver electrode paste on the substrate using screen printing, and baking the applied paste.

Next, dielectric glass layer 13 is formed by applying a paste that includes a lead low-melting glass using a screen printing method, so as to cover the surface of front glass substrate 11 on which display electrodes 12 have been formed, and baking the applied paste (approx. 550° C. to 590° C. inclusive). For example, the composition of dielectric glass layer 13 is 70 w % (weight percent) lead oxide (PbO), 15 w % boron oxide ($B_2O_3$), and 15 w % silicon oxide ($SiO_2$).

Moreover, in forming dielectric glass layer 13, apart from the above method, it is acceptable to use a bismuth low-melting glass, or to layer a lead low-melting glass and a bismuth low-melting glass.

Figure 3:
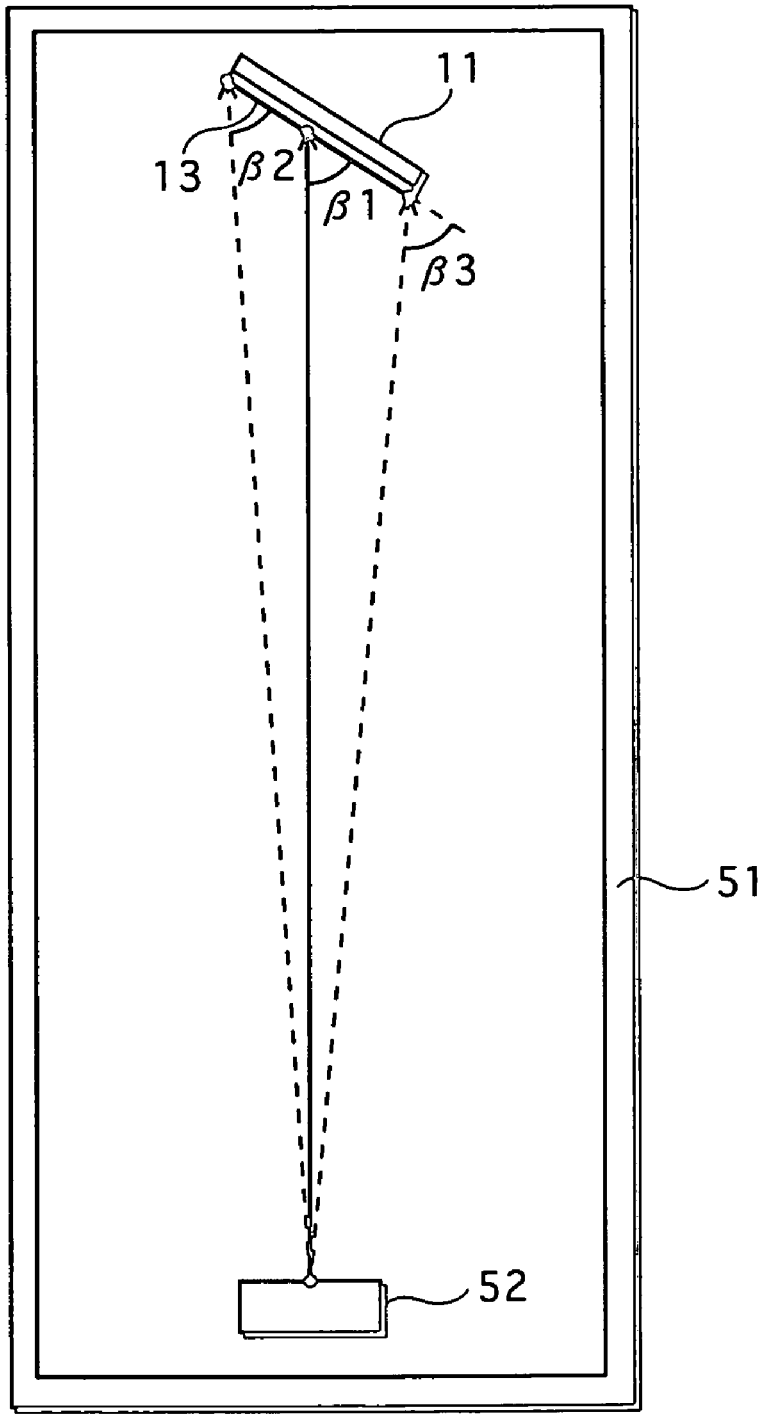
FIG. 3 is a schematic structural diagram of a device for forming a dielectric protective film 14 by oblique evaporation.

Furthermore, in the present embodiment, dielectric protective film 14 made from MgO is formed on dielectric glass layer 13 using a vacuum evaporation method, and it is preferable, at the time of forming film 14 using the vacuum evaporation method, to conduct oblique evaporation. Oblique evaporation is described using FIG. 3. FIG. 3 is a schematic structural diagram of a device for forming dielectric protective film 14 by oblique evaporation.

As shown in FIG. 3, a target 52 made from MgO in affixed to a support stand (not depicted) at a lower section within a chamber 51, and front glass substrate 11 on which dielectric glass layer 13 has been formed is placed quietly at an upper section within chamber 51. As can be seen in FIG. 3, front glass substrate 11 is placed quietly so as to be at predetermined angles (β1, β2, β3) with respect to target 52. For example, the predetermined angles (β1, β2, β3) are in a range of 60° C. to 80° C. inclusive.

Although not depicted in FIG. 3, in the actual chamber 51 is included a vacuum pump for decompressing the inside of chamber 51, and possibly a heater for heating target 52, and a heater for heating front glass substrate 11.

Dielectric protective film 14 formed using a forming device such as this has a large surface area per volume, and a high electron emission ability.

Moreover, in the oblique evaporating, front glass substrate 11 is heated to within an inclusive range of 200° C. or possibly 300° C. to the melting temperatures of front glass substrate 11, display electrodes 12, and perhaps dielectric glass layer 13.

As a result, dielectric protective film 14 made of single columnar crystals and having many gaps between the crystals (MgO weight density of 70% to 85% inclusive of single crystal material, or 70% to 80% inclusive depending on conditions) is formed on dielectric glass layer 13.

Front panel 10 is thus manufactured as described above.

Moreover, dielectric protective film 14 does not necessarily have to be formed by conducting oblique evaporation, and may be formed using a method other than a vacuum evaporation method, such as, for example, a sputtering method, an application method, or the like.

4-2. Manufacture of Back Panel 20

When manufacturing back panel 20, firstly data electrodes are formed on back glass substrate 21 by screen printing a silver electrode paste on substrate 21, and baking the applied paste.

Next, (white) dielectric glass layer 23 is formed by applying a glass material paste that includes titanium oxide ($TiO_2$) particles using a screen printing method, so as to cover the surface of back glass substrate 21 on which data electrodes 22 have been formed, and baking the applied paste (approx. 550° C. to 590° C. inclusive).

Barrier ribs 24 are formed by applying a glass paste for barrier ribs on dielectric glass layer 23 using a screen printing method, and baking the applied paste.

Next, phosphor layers 25 are formed by using a screen printing method to apply phosphor pastes of the colors red (R), green (G) and blue (B) to the walls of grooves formed by barrier ribs 24 and dielectric glass layer 23, and baking the applied pastes in a vacuum (eg. 10 min. at 500° C.). As the phosphor materials forming phosphor layers 25, here the following are used:

Blue Phosphors: $BaMgAl_{10}O_{17}$:Eu

Green Phosphors: $Zn_2SiO_4$:Mn.

Red Phosphors: (Y,Gd)$Bo_3$:Eu

Back Panel 20 is thus manufactured as described above.

Moreover, in forming phosphor layers 25, it is also possible to use a method such as an inkjet method, a linejet method, or a method in which a photosensitive resin sheet that contains phosphor materials of the various colors is manufactured, the manufactured sheet is adhered to the surface of back glass substrate 21 on which barrier ribs 24 have been provided, and unnecessary parts of the adhered sheet are removed by patterning and developing using a photolithograph method.

4-3. Sealing of Front Panel 10 and Back Panel 20

The sealing of front panel 10 and back panel 20 manufactured as above will now be described using FIGS. 4A to 4D.

Figure 4A:
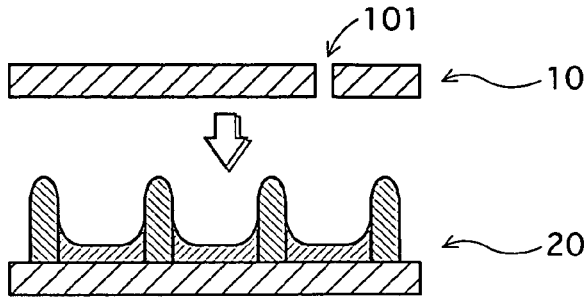
FIGS. 4A-4D are schematic diagrams of the various processes of sealing, exhausting, and gas induction.

As shown in FIG. 4A, front panel 10 and back panel 20 are sealed so that dielectric protective film 14 and phosphor layers 25 formed thereon respectively face one another. The sealing preferably is conducted using a frit glass around an external periphery of one or both of front panel 10 and back panel 20.

As shown in FIG. 4A, an air hole 101 for exhausting discharge spaces 30 and for inducing rare gas, carbon dioxide and so forth is provided in front panel 10.

Figure 4B:
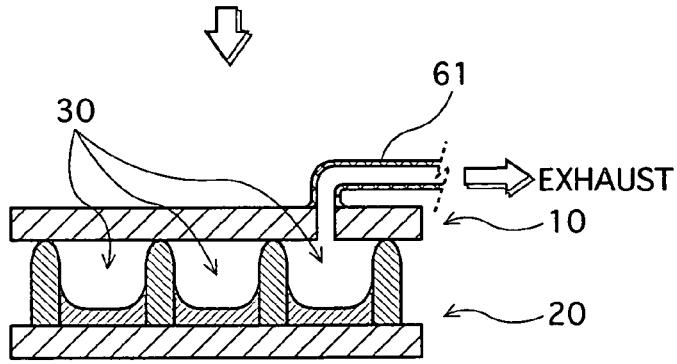

Next, as shown in FIG. 4B, an air pipe 61 is connected to air hole 101 provided in front panel 10, and evacuation of discharge spaces 30 is conducted via air pipe 61 (eg. at 360° C. to 450° C. inclusive for 6 hrs or more).

The baking of the panel is conducted in parallel with the evacuation of discharge spaces 30.

Furthermore, the timing at which the evacuation is commenced preferably is when the temperature of the frit glass at a time of the sealing in the above FIG. 4A has fallen below its softening point. Moreover, this limitation does not apply in the event of the atmosphere in the panel environs being a vacuum.

The evacuation preferably is conducted until a residual gas pressure within discharge spaces 30 is no more than 0.02 mPa (high vacuum state). The residual gas component approaches an air component at a normal temperature, and is occupied to a large extent by nitrogen, oxygen, and water vapor.

Figure 4C:
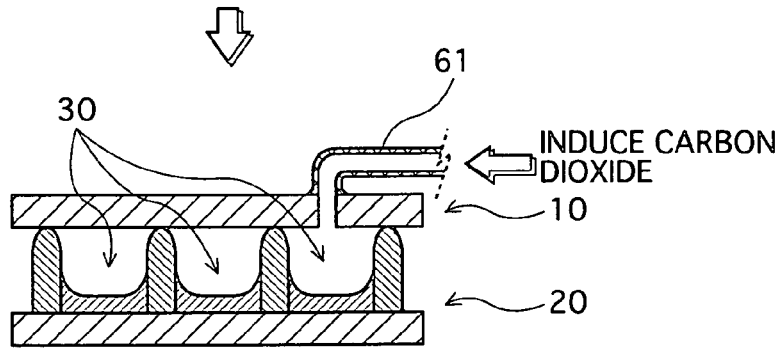

As shown in FIG. 4C, a required amount of carbon dioxide is induced as a secondary gas into discharge spaces 30 via air pipe 61 after evacuation. The induced amount of carbon dioxide is, as described above, such that the partial pressure of the carbon dioxide within discharge spaces 30 is in a range of 0.05 mPa to 5 mPa inclusive, and preferably in a range of 0.05 mPa to 0.5 mPa inclusive.

Figure 4D:
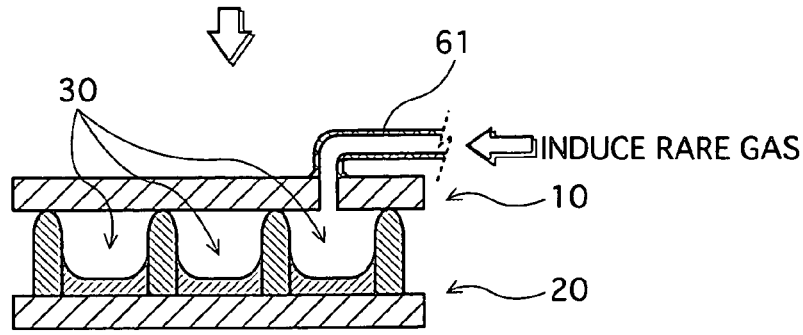

As shown in FIG. 4D, a so-called rare gas such as an Ne—Xe gas or an He—Xe gas is induced via air pipe 61. The induced amount of rare gas is such that the partial pressure of the rare gas within discharge spaces 30 is in a range of 40 kPa to 80 kPa inclusive.

Finally, although not depicted, after removing air pipe 61, air hole 101 provided in front panel 10 is closed off, with care being taken to ensure that carbon dioxide or rare gas does not leak out, and that impurities do not get mixed within discharge spaces 30, thus completing PDP 1.

By including carbon dioxide together with a rare gas as the primary gas in discharge spaces 30 as described above, so that a partial pressure of the carbon dioxide is in a range of 0.05 mPa to 5 mPa inclusive, and preferably in a range of 0.05 mPa to 0.5 mPa inclusive, it is possible in PDP 1 to obtain, in addition to a low discharge starting voltage, an optimal value of the electron emission ability possessed by the formed dielectric protective film 14.

Consequently, with PDP 1, occurrence of write errors in the write period when PDP 1 is driven is suppressed and high-speed driving at a low drive voltage is possible.

Furthermore, the superior qualities that the above PDP 1 are marked when the dielectric protective film (MgO) has a high electron emission ability, and the statistical delay time is short even within the discharge delay time. For example, the effect is marked in the case of the dielectric protective film having characteristics in which the statistical delay time shows 40 nsecs to 100 nsecs inclusive when a 1.7 μ sec pulse is displayed at only one point on a screen at an applied voltage of 265 V.

Moreover, a value of the electron emission ability obtained when discharge spaces 30 are filled with only rare gas is originally the optimal value from the viewpoint of reducing the likelihood of write errors occurring. The flipside of that, however, is that it is difficult to realize a low discharge starting voltage when discharge spaces 30 are filled with only rare gas. Accordingly, with PDP 1, by including carbon dioxide having a partial pressure of 0.05 mPa to 0.5 mPa inclusive in discharge spaces 30 as described above, both write error suppression and discharge starting voltage reduction is realized.

Although a detailed investigation has not been made in relation to mechanisms that allow PDP 1 to realize the above effects, the optimal kinds of impurities and the optimal amounts for inclusion have been confirmed as a result of the experiments described below.

However, while PDP 1 in which carbon dioxide is included in discharge spaces 30 at the above partial pressure satisfies the preferred discharge starting voltage and electron emission ability as a display panel, the electron emission ability varies greatly with respect to the temperature of the surfaces facing discharge spaces 30. Specifically, with PDP 1 in which dielectric protective film 14 is formed using MgO, a drop in the surface temperature of dielectric protective film 14 is followed also by a drop in the electron emission ability.

Immediately after the initialization period at a time of driving the panel, the absolute amount of accumulated wall charge decreases as a result of the temperature dependency of the electron emission ability, and additionally the temperature dependency does not become that great because of the activation of discharge spaces 30 in the initialization period. As a result, the decrease in wall charge is extremely great, causing everything from write errors to display errors.

Consequently, with the above partial pressure of carbon dioxide, while an environment temperature in a range of 25° C. to 40° C. is sufficient to obtain an optimal value of the electron emission ability possessed by MgO, when, for example, an environment temperature of 10° C. or below is assumed, the partial pressure of the carbon dioxide preferably is set from 0.1 mPa to 0.2 mPa inclusive.

Moreover, although in the above embodiment, characteristics of the present invention are described using a PDP as an example, it is possible to obtain similar effects with the same structure if a gas discharge panel or a gas discharge display device that has discharge spaces filled with a rare gas and that accumulates wall charge when driven.

Furthermore, although in the above manufacturing method, carbon dioxide is induced as a secondary gas after exhausting discharge spaces 30 to a high vacuum of 0.02 mPa or less, after which a rare gas as a primary gas is induced, if it is possible for the carbon dioxide partial pressure in the discharge spaces to ultimately be in the above range, the process method is not limited to the above method and may be any method. For example, one possible method of including a required amount of carbon dioxide in discharge spaces 30 involves optimizing the exhausting conditions (heating temperature, exhausting time period, etc.) so as to evacuate discharge spaces 30 to a state in which the required amount of carbon dioxide remains, and then inducing only rare gas.

Furthermore, another possible method involves making a mixed gas by premixing carbon dioxide and a rare gas, inducing the mixed gas into discharge spaces 30 that have been evacuated to a high vacuum (e.g. 0.02 mPa or less), and then inducing a pure rare gas until the pressure within discharge spaces 30 reaches a predetermined pressure.

In other words, the present invention is not limited or restricted in any particular way in relation to areas other than the essence of the invention, which is to include a required amount of a secondary gas with a rare gas that forms a primary gas within discharge spaces 30.

Variations

Although in the above embodiment, carbon dioxide having a partial pressure in a range of 0.05 mPa to 5 mPa inclusive or preferably 0.05 mPa to 0.5 mPa inclusive, is included in discharge spaces 30 together with a rare gas, it is possible for a gas discharge panel to obtain similar effects to the above PDP 1, if the secondary gas is of a type and within the partial pressure ranges shown below.

(1) carbon dioxide having a partial pressure of 1 mPa to 5 mPa inclusive
(2) carbon dioxide having a partial pressure of 1.5 mPa to 3 mPa inclusive
(3) water vapor having a partial pressure of 1 mPa to 10 mPa inclusive
(4) water vapor having a partial pressure of 2 mPa to 5 mPa inclusive
(5) oxygen having a partial pressure of 0.3 mPa to 5 mPa inclusive
(6) oxygen having a partial pressure of 1 mPa to 3 mPa inclusive
(7) carbon dioxide having a partial pressure of 0.5 mPa to 1 mPa inclusive and oxygen having a partial pressure of 1 mPa to 5 mPa inclusive
(8) carbon dioxide having a partial pressure of 0.5 mPa to 1 mPa inclusive and oxygen having a partial pressure of 2 mPa to 3 mPa inclusive
(9) water vapor having a partial pressure of 5 mPa to 20 mPa inclusive and nitrogen having a partial pressure of 1 Pa to 6 Pa inclusive
(10) water vapor having a partial pressure of 2 mPa to 10 mPa inclusive and nitrogen having a partial pressure of 2 Pa to 3 Pa inclusive
(11) water vapor having a partial pressure of 1 mPa to 10 mPa inclusive and carbon dioxide having a partial pressure of 0.05 mPa to 0.5 mPa inclusive
(12) water vapor having a partial pressure of 1 mPa to 8 mPa inclusive and carbon dioxide having a partial pressure of 0.1 mPa to 0.5 mPa inclusive
(13) water vapor having a partial pressure of 2 mPa to 5 mPa inclusive and carbon dioxide having a partial pressure of 0.1 mPa to 0.2 mPa inclusive
(14) water vapor having a partial pressure of 5 mPa to 20 mPa inclusive and oxygen having a partial pressure of 0.2 mPa to 2 mPa inclusive
(15) water vapor having a partial pressure of 5 mPa to 10 mPa inclusive and oxygen having a partial pressure of 0.5 mPa to 1.5 mPa inclusive Moreover, although the inclusion of nitrogen independently within discharge spaces 30 is not recited in the above (1) to (15), the possibility exists of a gas discharge panel being able to have superior qualities similar to those described above, even when nitrogen is included independently within discharge spaces 30.

Furthermore, although it is generally considered that the life of a PDP is shortened and the electron emission ability is reduced when impurities other than a rare gas remain within discharge spaces 30, the exerted influence is minimal and no practical problems arise if the residual amount of impurities is at a stipulated partial pressure within the ranges given above.

Confirmation Experiments

While the above description relates to including impurities having the above compositions and partial pressures in discharge spaces 30 so as to achieve a low discharge voltage and high driving speeds without write errors occurring in the write period when a PDP is driven, the following description relates to confirmation experiments that support these effects.

Figure 5:
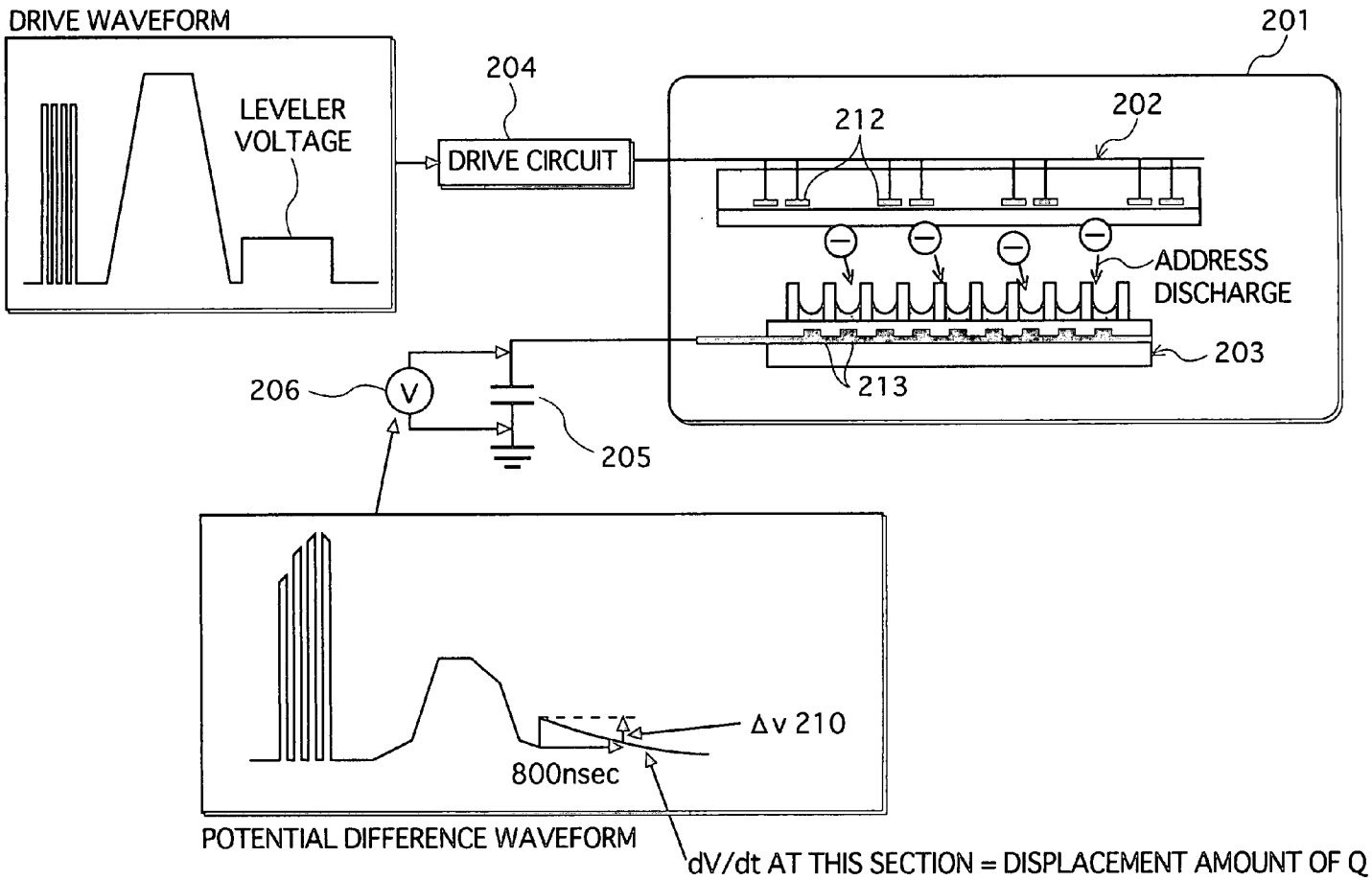
FIG. 5 is a schematic diagram of an experiment device used in a confirmation experiment.

Firstly, a structure of a device used in the experiments is described using FIG. 5.

As shown in FIG. 5, in the experiments, a discharge sample that enables a write discharge was formed within an airtight container 201.

The discharge sample was structure from a front panel sample 202 in which electrodes 212 are formed and a back panel sample 203 in which electrodes 213 are formed.

A drive circuit 204 was connected to electrodes 212 in front panel sample 202, and a drive waveform as shown in FIG. 5 was applied repeatedly to electrodes 212.

On the other hand, electrodes 213 in back panel sample 203 were grounded via a condenser 205.

Also, airtight container 201 was filled with an Ne—Xe (95% Ne, 5% Xe) gas as a primary gas at a pressure of approximately 50 kPa to 70 kPa, and a require amount of a secondary gas was included in airtight container 201. In the present experiments, evaluation of the discharge sample was conducted while varying the component and partial pressure of the secondary gas.

When a pulse having a drive waveform shown in FIG. 5 was applied to electrodes 212 of front panel sample 212 from drive circuit 204 in such an experiment device, a write discharge was generated between electrodes 212 and electrodes 213, and electric charge flowed from electrodes 213 via condenser 205. While a potential difference occurred at both ends of condenser 205 at this time, in the present experiments, the waveform of this potential difference was measured using an oscilloscope, and the amount of the flow charge was determined. This was determined so as to ensure that the charge amount accumulated in condenser 205 was in parity with a value obtained when the flow charge was temporally integrated.

Consequently, the transference amount of charge per unit time was determined by differentiating the charge amount by time.

Moreover, in the present experiments, when an electric field was not applied positively from an external source after application of the initialization voltage, measurement was conducted using, as an electron emission ability (arbitrary unit), a displacement amount (ΔV 210) relating to how much the potential difference of condenser 205 changes after 800 nsecs from when the initialization voltage was applied, in order to comprehend the gradual transference of electric charge from a surface of front panel sample 202 to back panel sample 203.

In relation to the measurement results, values (discharge starting voltage, electron emission ability) when a secondary gas was not included were set as reference values, and obtained values were divided by these reference values and shown as relative values. In the actual experiments, however, setting the impurities in airtight container 201 to zero was unrealistic, and so evacuation was conducted until the residual gas pressure was 0.02 mPa, and values obtained when filled only with a rare gas were set as reference values.

Experiment 1: Carbon Dioxide Used as Secondary Gas

Figure 6:
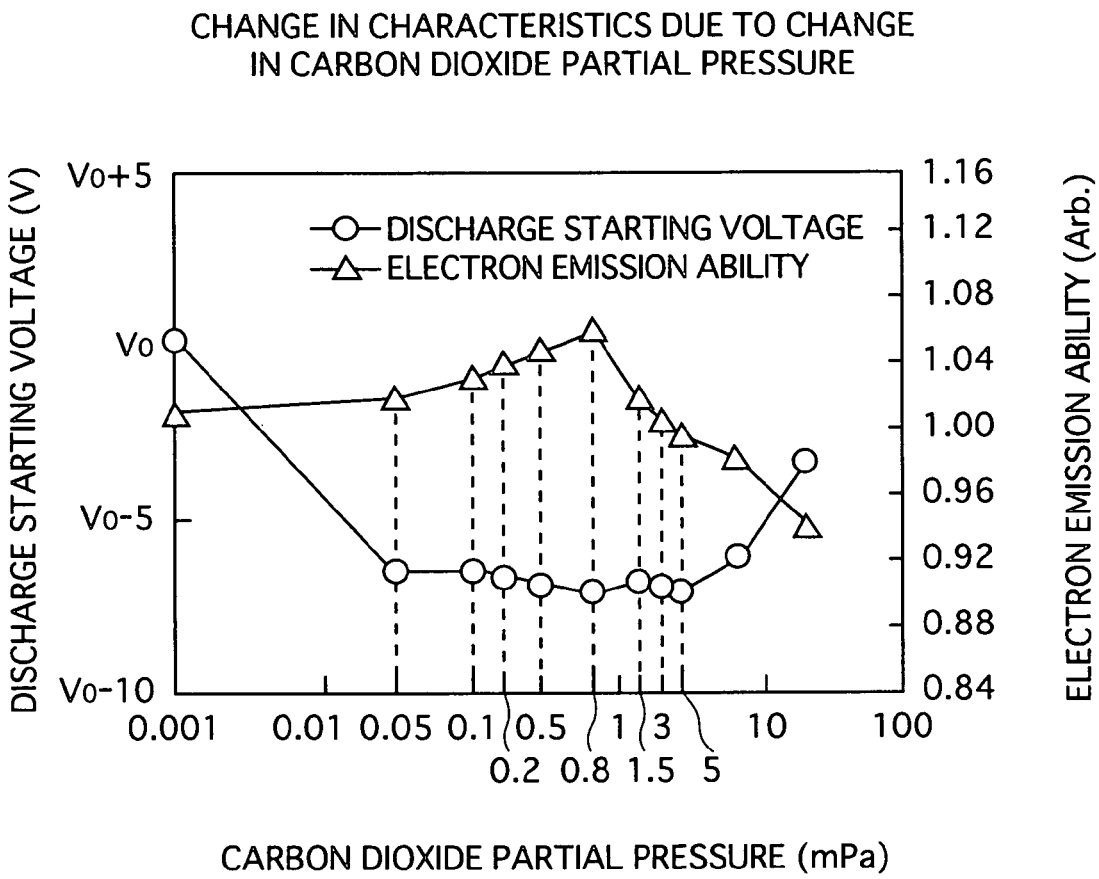
FIG. 6 is a characteristics diagram showing a relationship between (i) a partial pressure of carbon dioxide included in an airtight container and (ii) a discharge starting voltage and an electron emission ability.

In experiment 1, the discharge starting voltage and electron emission ability when only carbon dioxide was included as a secondary gas in airtight container 201 were measured, the results being shown in FIG. 6.

As shown in FIG. 6, the discharge starting voltage becomes smaller with increases in partial pressure at a carbon dioxide partial pressure in a range up to but not including 0.05 mpa. The discharge starting voltage then remains steady at ($V_0$−7) to ($V_0$−8) when the carbon dioxide partial pressure is in a range of 0.05 mPa to 5 mPa, this being lower than when a secondary gas is not included. The discharge starting voltage when the carbon dioxide partial pressure is greater than 5 mPa increases together with increases in partial pressure. Here, $V_0$ in the diagrams is the discharge starting voltage when the carbon dioxide partial pressure is approximately 0.001 mPa, this being the voltage used for reference.

On the other hand, the electron emission ability is stable at 1.02 to 1.04 when the carbon dioxide partial pressure is in a range up to and including 0.5 mpa. When the carbon dioxide partial pressure exceeds 0.5 mpa, the curve showing the electron emission ability begins to rise and reaches a peak value (1.08) when the carbon dioxide partial pressure is from 0.7 mPa to 0.8 mpa. Then, the electron emission ability gradually decreases from the peak value when the carbon dioxide partial pressure increases above 0.8 mpa. It can be seen that when the carbon dioxide partial pressure is greater than 5 mpa, the degree at which the electron emission ability decreases is great.

As far as the preferred numeric range of the discharge starting voltage is concerned, the lower the better.

Figure 12:
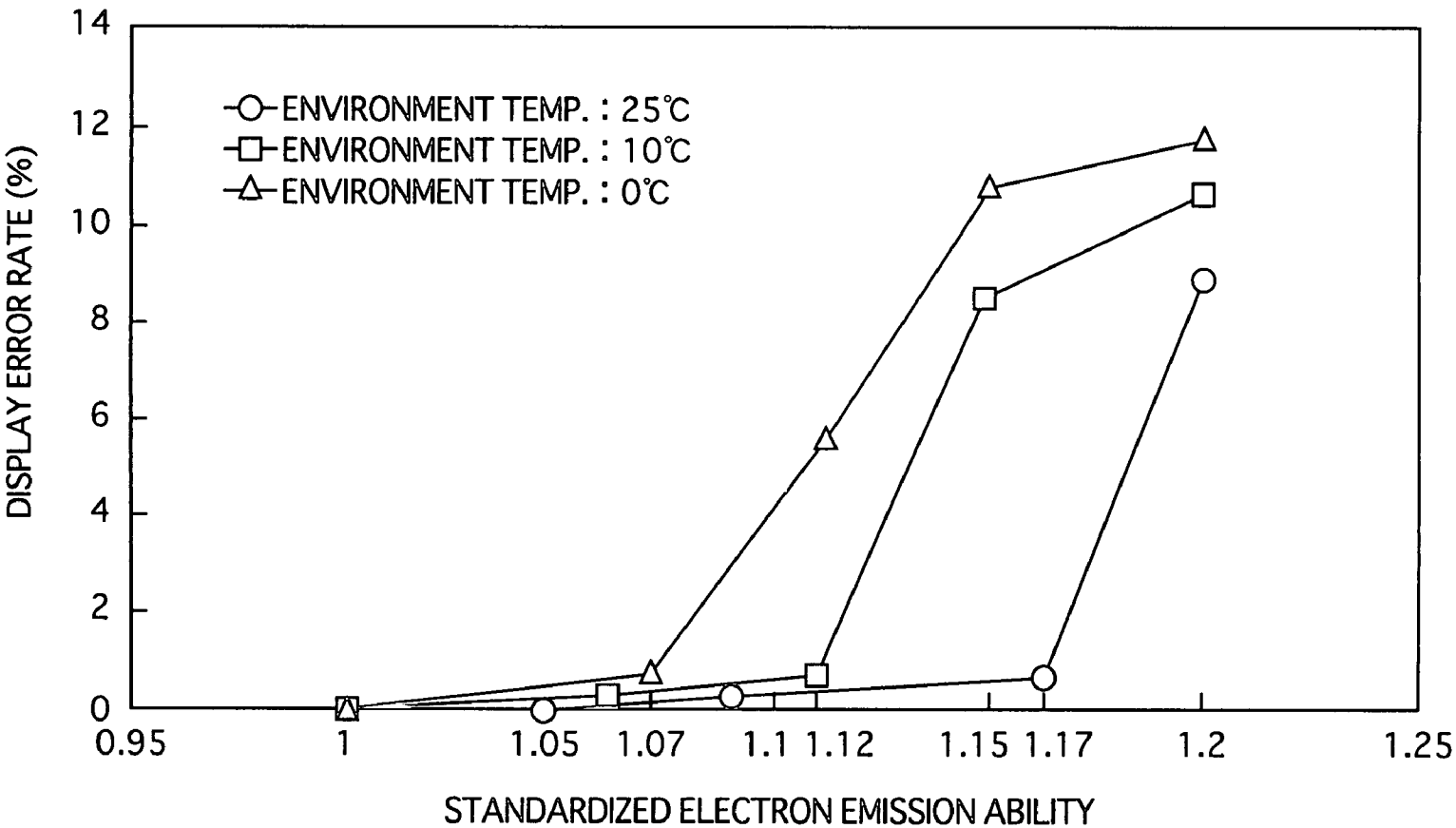
FIG. 12 is a characteristics diagram showing a relationship between an electron emission ability and a display error rate at various temperatures.

On the other hand, the preferred range of the electron emission ability is described using FIG. 12.

As shown in FIG. 12, the preferred range of the electron emission ability also varies depending on the environment temperature. For example, when the environment temperature is 25° C., the preferred range of the electron emission ability can be said to be a range up to and including 1.17, at which point the display error rate is less than 1%.

Likewise, when the environment temperature is 10° C., the preferred range of the electron emission ability is 1.12 or less. Then, when the environment temperature is 0° C., the preferred range of the electron emission ability is 1.07 or less.

In the event of an environment temperature of 25° C., a preferable carbon dioxide partial pressure from the standpoint of the discharge starting voltage is a range of 0.05 mPa to 5 mPa inclusive, and in order to satisfy the preferred discharge starting voltage range and the preferred electron emission ability range, a carbon dioxide partial pressure in a range of 0.05 mPa to 0.5 mPa inclusive and 1 mPa to 5 mPa inclusive allows these two ranges to be optimized.

Also, when considering the case of the environment temperature being 10° C. as mentioned above, the preferred carbon dioxide partial pressure is in a range of 0.1 mPa to 0.2 mPa inclusive and 1.5 mPa to 3 mPa inclusive.

Experiment 2: Oxygen Used as Secondary Gas

Figure 7:
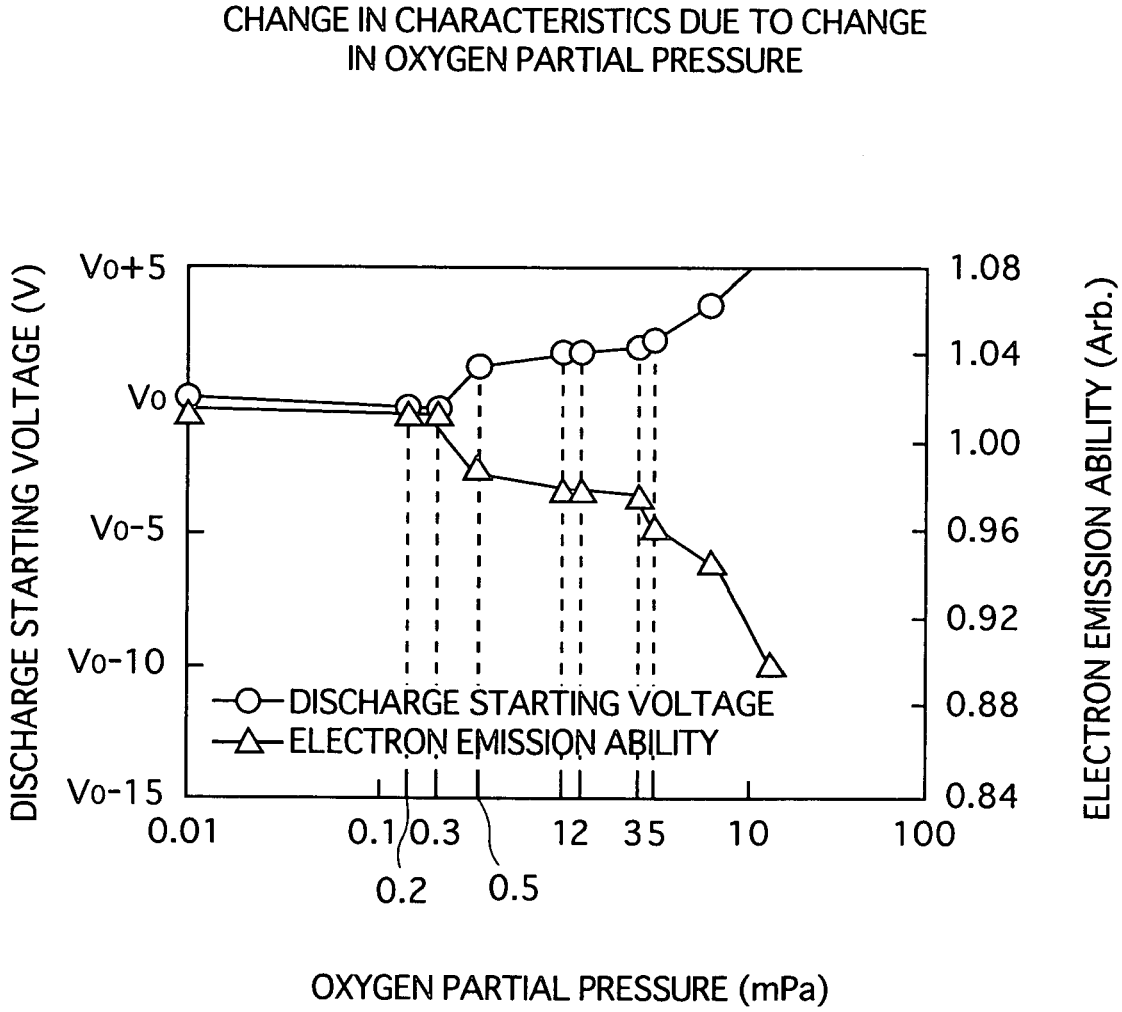
FIG. 7 is a characteristics diagram showing a relationship between (i) a partial pressure of oxygen included in an airtight container and (ii) a discharge starting voltage and an electron emission ability.

In experiment 2, the discharge starting voltage and electron emission ability when oxygen was included as a secondary gas in airtight container 201 were measured, the results being shown in FIG. 7.

As shown in FIG. 7, when the oxygen partial pressure is less 0.3 mPa, the discharge starting voltage and electron emission ability are both without change and stable.

When the oxygen partial pressure is in a range greater than or equal to 0.3 mPa, the discharge starting voltage increases with increases in the oxygen partial pressure, and the electron emission ability conversely is reduced. The degree of the rise in discharge starting voltage and the degree of the fall in the electron emission ability can be seen to increase at oxygen partial pressures exceeding 5 mPa.

The preferred numeric ranges of the discharge starting voltage and the electron emission ability are as described above.

From the experiment results shown in FIG. 7, it can be seen that in order to satisfy the above numeric ranges, the oxygen partial pressure should be set in a range of 0.3 mPa to 5 mPa inclusive.

When considering the case of the environment temperature being 10° C. as described above, the oxygen partial pressure preferably is set in a range of 1 mPa to 3 mPa inclusive.

Experiment 3: Water Vapor Used as Secondary Gas

Figure 8:
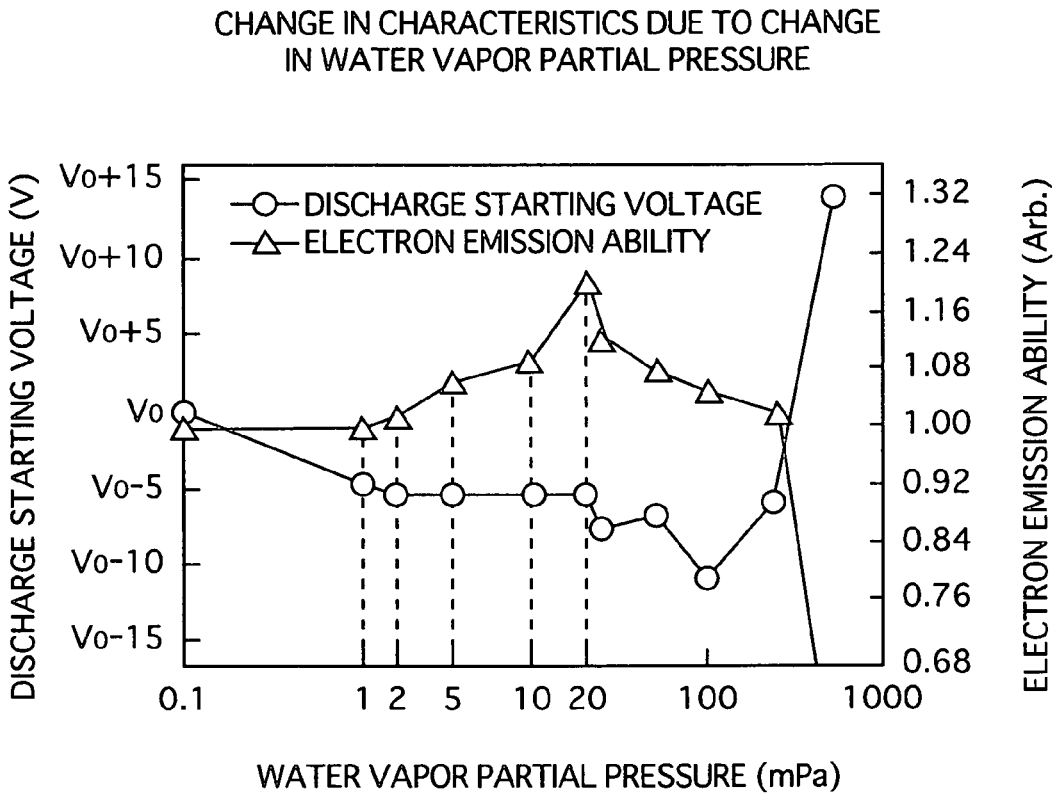
FIG. 8 is a characteristics diagram showing a relationship between (i) a partial pressure of water vapor included in an airtight container and (ii) a discharge starting voltage and an electron emission ability.

In experiment 3, the discharge starting voltage and electron emission ability when water vapor was included as a secondary gas in airtight container 201 were measured, the results being shown in FIG. 8.

As shown in FIG. 8, the discharge starting voltage, at a water vapor partial pressure in a range up to but not including 1 mpa, gradually decreases, and stabilizes at around 260 V when the water vapor partial pressure is in a range of 1 mPa to 20 mPa inclusive. Although the discharge starting voltage decreases when the water vapor partial pressure exceeds 20 mPa, it rapidly increases when the water vapor partial pressure exceeds 100 mPa.

On the other hand, the electron emission ability rises with increases in water vapor partial pressure at a water vapor partial pressure in a range up to and including 20 mPa. The degree of this rise, however, becomes great when the water vapor partial pressure exceeds 10 mpa. The electron emission ability peaks when the vapor partial pressure is approximately 20 mPa, and decrease after that.

The preferred numeric ranges of the discharge starting voltage and the electron emission ability are as described in the above experiments 1 and 2.

From the experiment results shown in FIG. 8, it can be seen that in order to satisfy the above numeric ranges, the water vapor partial pressure should be set in a range of 1 mPa to 10 mPa inclusive. Then, when considering the case of the environment temperature being 10° C., the water vapor partial pressure should be set in a range of 2 mPa to 5 mPa inclusive.

Experiment 4: Nitrogen Used as Secondary Gas

As described above, although no merit was seen in including nitrogen independently as a secondary gas in a gas discharge panel having the present dielectric protective film made from MgO, a confirmation experiment was still conducted with nitrogen included independently.

Figure 9:
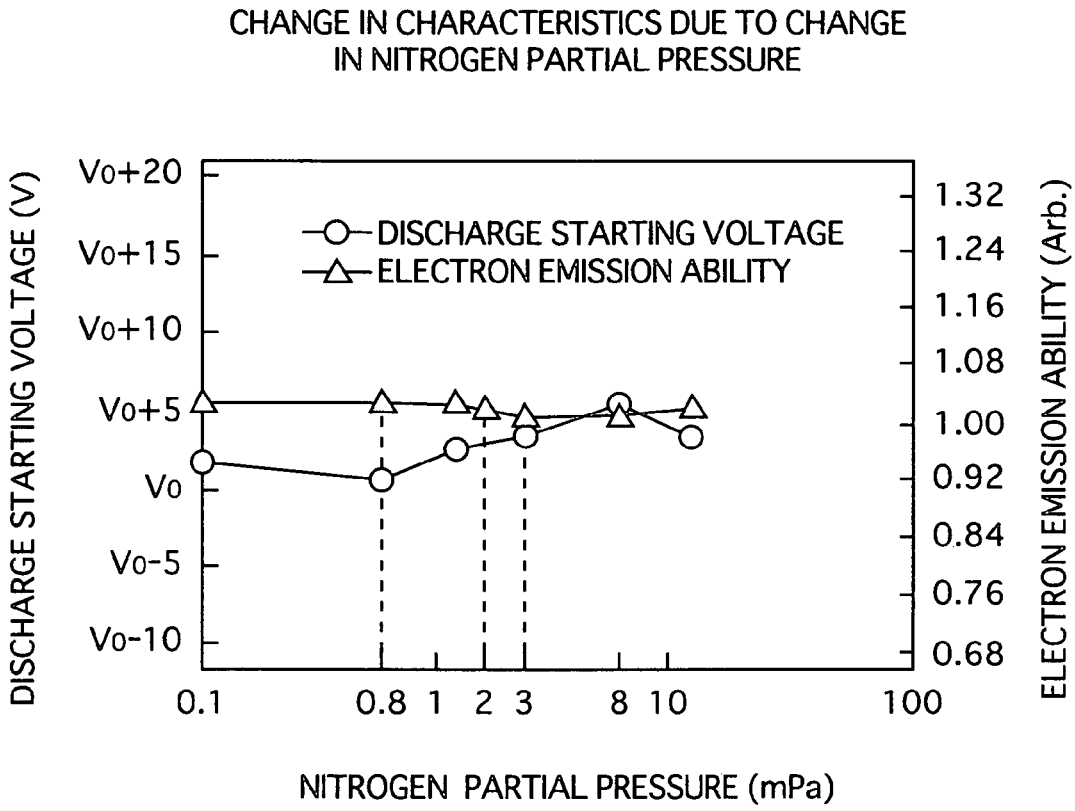
FIG. 9 is a characteristics diagram showing a relationship between (i) a partial pressure of nitrogen included in an airtight container and (ii) a discharge starting voltage and an electron emission ability.

As shown in FIG. 9, when nitrogen is included, the discharge starting voltage is stable at a nitrogen partial pressure in a range up to but not including 0.8 Pa. As the nitrogen partial pressure increases, the discharge starting voltage slowly rises, and then conversely decreases when the nitrogen partial pressure exceeds 8 Pa.

On the other hand, the electron emission ability maintains an approximately constant value $V_0$ without being influenced much by the nitrogen partial pressure.

As can also be ascertained from the above results, although there is not much merit with a gas discharge panel having the present dielectric protective film, even when nitrogen is included independently in discharge spaces 30 as an impurity, it can be anticipated that, depending on the condition of dielectric protective films, superior qualities such as the above will be obtainable, even when nitrogen is included independently in discharge spaces 30 as an impurity.

Experiment 5: Carbon Dioxide and Oxygen Used Together as Secondary Gas

In experiment 5, the discharge starting voltage and electron emission ability were measured when carbon dioxide and oxygen were included together as a secondary gas in airtight container 201. The result in this case is the algebraic sum of the result obtained when carbon dioxide was included independently and the result obtained when oxygen was included independently, and thus a drawing is not provided.

From this experiment result, when carbon dioxide and oxygen are included together as a secondary gas in a discharge space of a gas discharge panel, the discharge starting voltage and the electron emission ability are both optimized if the carbon dioxide partial pressure is 0.5 mPa to 1 mPa inclusive and the oxygen partial pressure is 1 mPa to 5 mPa inclusive.

In the above result, the preferred range of the carbon dioxide partial pressure is set from 0.5 mPa to 1 mPa inclusive so as to be able to balance the demerit of the rise in the electron emission ability that occurs when carbon dioxide is included independently, by combining oxygen. In other words, with this combination, an amount of carbon dioxide that would be consider excessive when included independently is induced, and the demerit of the rising electron emission ability that occurs as a result is counteracted by including oxygen.

Consequently, when carbon dioxide and oxygen are included together in a discharge space, it is possible to draw out the excellent characteristics in terms of both the discharge starting voltage and the electron emission ability, in comparison with when either carbon dioxide or oxygen are included independently.

Also, when the carbon dioxide partial pressure is in the range detailed above, and the oxygen partial pressure is set in a range of 2 mPa to 3 mPa inclusive, it is possible to respond even at an environment temperature of 10° C., this being most preferable. This is because, if the oxygen partial pressure is set within the above range, the line of the electron emission ability decreases gently within the range, and it is possible to optimally suppress the above-mentioned rise in the electron emission ability.

Experiment 6: Water Vapor and Nitrogen Used Together as Secondary Gas

In experiment 6, the discharge starting voltage and electron emission ability were measured when water vapor and nitrogen were included together as a secondary gas in airtight container 201. The result in this case, as with experiment 5, is the algebraic sum of the result obtained when water vapor was included independently and the result obtained when nitrogen was included independently, and thus a drawing is not provided.

From this experiment result, when water vapor and nitrogen are included together as a secondary gas in a discharge space of a gas discharge panel as impurities, it is possible to satisfy the above preferred ranges of the discharge starting voltage and the electron emission ability if the water vapor partial pressure is 5 mPa to 20 mPa inclusive and the nitrogen partial pressure is 1 Pa to 6 Pa inclusive. This is because, if the water vapor partial pressure is from 5 mPa to 20 mPa inclusive, it is possible to lower the discharge starting voltage, and because, if the nitrogen partial pressure is from 1 Pa to 6 Pa inclusive, it is possible to suppress the rise in the electron emission ability resulting from the water vapor partial pressure being from 5 mPa to 20 mPa inclusive.

Furthermore, when the water vapor partial pressure is 2 mPa to 10 mPa inclusive and the nitrogen partial pressure is 2 Pa to 3 Pa inclusive, it has been ascertained that a gas discharge panel having excellent characteristics and capable of responding even at an environment temperature of 10° C. is obtained.

Experiment 7: Water Vapor and Carbon Dioxide Used Together as Secondary Gas

Figure 10:
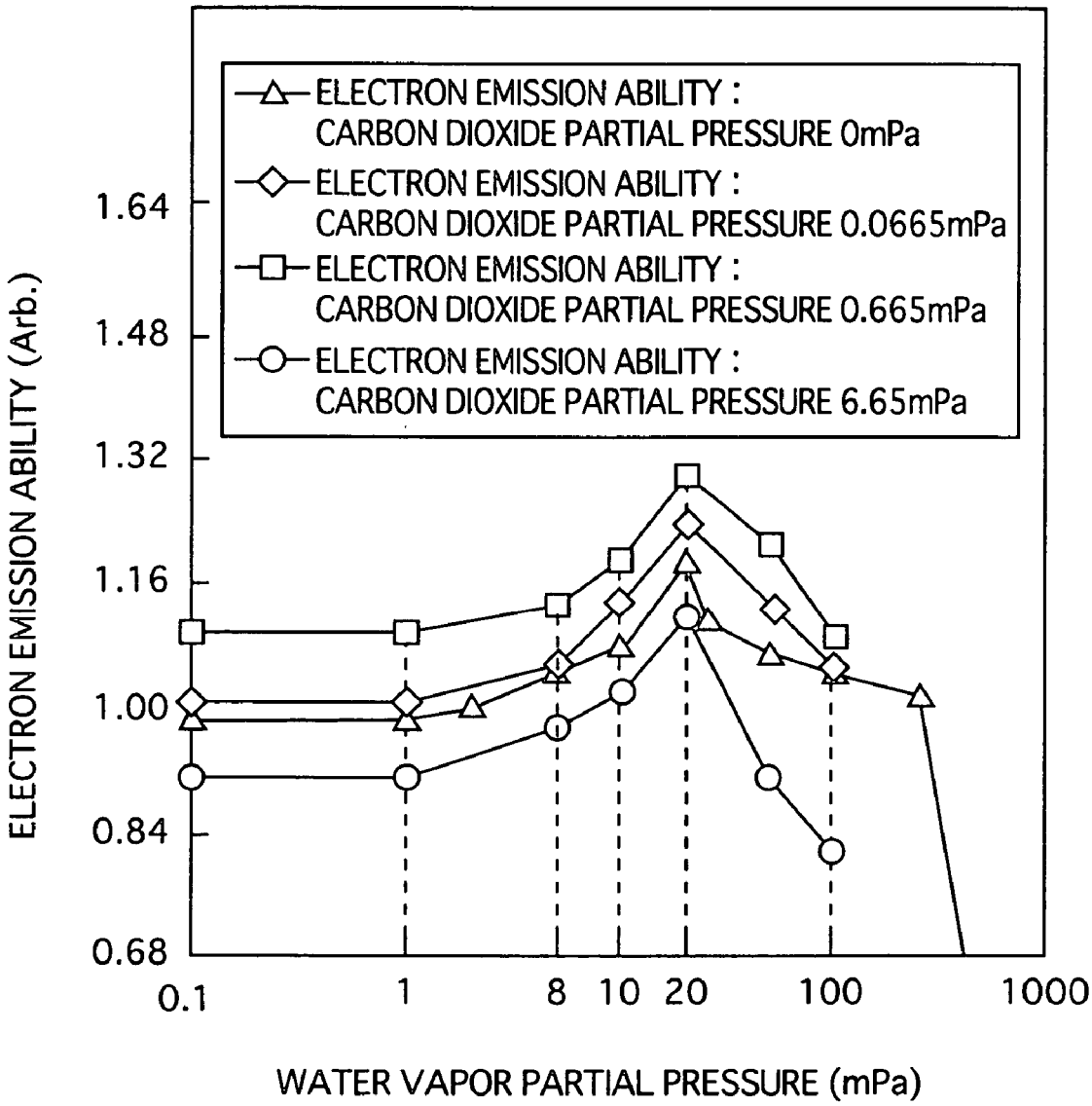
FIG. 10 is a characteristics diagram showing a relationship between respective partial pressures of water vapor and carbon dioxide included in an airtight container and an electron emission ability.
Figure 11:
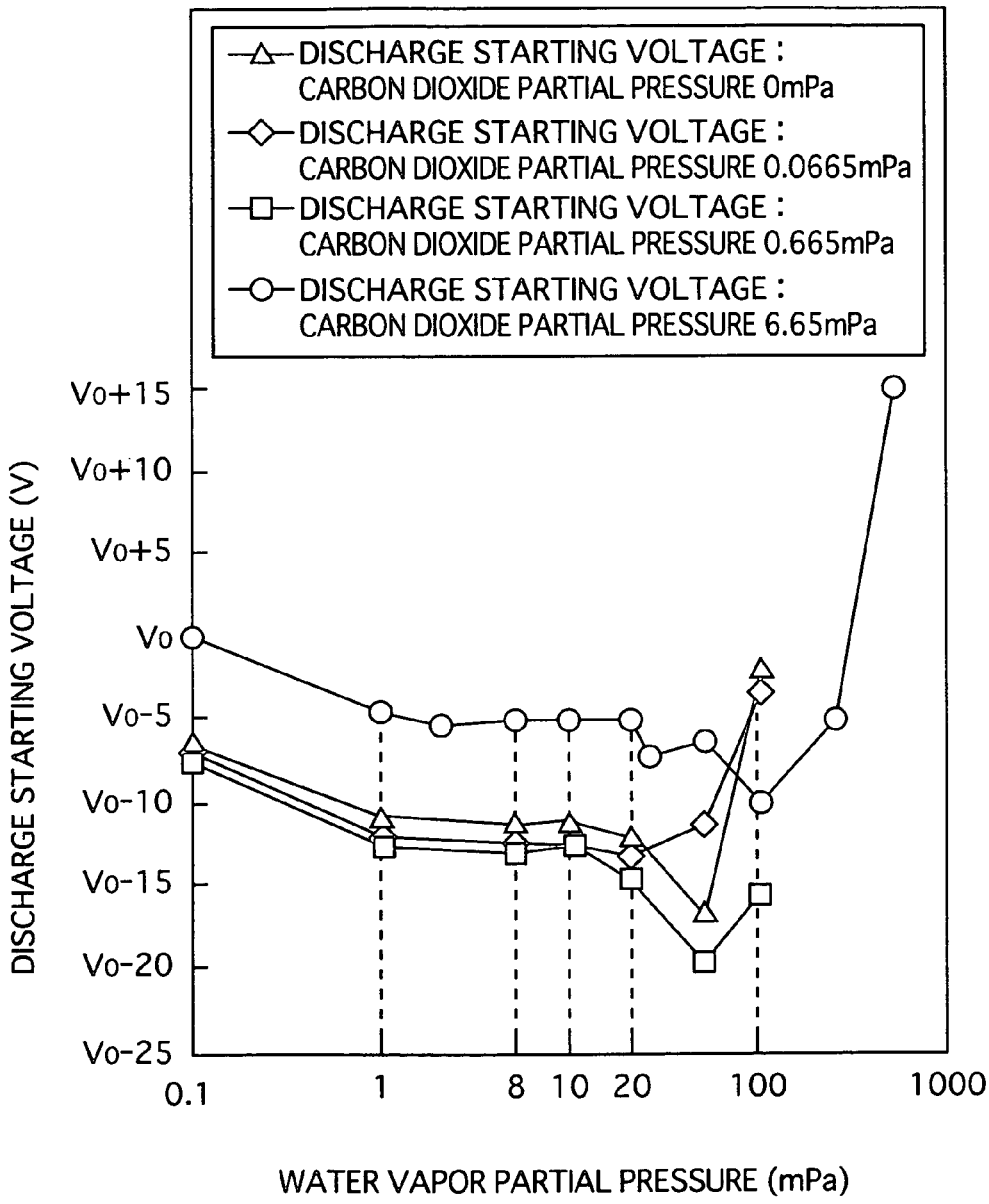
FIG. 11 is a characteristics diagram showing a relationship between respective partial pressures of water vapor and carbon dioxide included in an airtight container and a discharge starting voltage.

In experiment 7, the discharge starting voltage and electron emission ability were measured when water vapor and carbon dioxide were included together as a secondary gas in airtight container 201, the results being shown in FIGS. 10 and 11. FIG. 10 shows the change in the electron emission ability, and FIG. 11 shows the change in the discharge starting voltage.

As shown in FIG. 10, when water vapor and carbon dioxide were included in airtight container 201, the electron emission ability peaked when the water vapor partial pressure was in a vicinity of 20 mPa, irrespective of the carbon dioxide partial pressure.

Also, when FIG. 10 is viewed in terms of carbon dioxide partial pressure, the electron emission ability rose with increases in the carbon dioxide partial pressure, when the carbon dioxide partial pressure was in a range of 0 mPa (water vapor only) to 0.665 mPa.

However, when the carbon dioxide partial pressure was set to 6.65 mPa, the value of the electron emission ability was lower than when carbon dioxide was not included.

Next, as shown in FIG. 11, the discharge starting voltage, even when carbon dioxide is included together with water vapor in airtight container 201, has a similar relationship to the characteristics when only water vapor is included.

When FIG. 11 is viewed in terms of carbon dioxide partial pressure, although there are places where the order is reversed, the discharge starting voltage shows lower values at carbon dioxide partial pressures in the order 0.665 mpa, 0.0665 mPa, 6.65 mPa, and 0 mPa (water vapor).

When viewed as a gas discharge panel, the preferred numeric ranges of the discharge starting voltage and the electron emission ability are as detailed above.

From the experiment results shown in FIGS. 10 and 11, in order to satisfy the above preferred numeric ranges or to approach these ranges, the water vapor partial pressure should be set from 1 mPa to 10 mPa inclusive, and the carbon dioxide partial pressure should be set from 0.05 mPa to 0.665 mPa inclusive.

In the above, when the water vapor partial pressure is set from 1 mPa to 8 mPa inclusive, or when the carbon dioxide partial pressure is set to 0.0665 mPa or greater, a gas discharge panel having most excellent characteristics can be obtained. More preferable is a carbon dioxide partial pressure from 0.05 mPa to 0.5 mPa inclusive, and even more preferable is a range of 0.1 mPa to 0.5 mPa inclusive.

Furthermore, when the water vapor partial pressure is set from 2 mPa to 5 mPa inclusive, and the carbon dioxide partial pressure is set from 0.1 mPa to 0.2 mPa inclusive, it is possible to obtain excellent characteristics, even in the severe environment of a 0° C. environment temperature. The reason why the gas discharge panel characteristics (discharge starting voltage, electron emission ability) are excellent as a result of setting these numeric ranges is similar to the above embodiment; that is, because of the excellent characteristics being maintained, even with respect to changes in environment temperature.

Experiment 8: Water Vapor and Oxygen Used Together as Secondary Gas

In experiment 8, the discharge starting voltage and electron emission ability were measured when water vapor and oxygen were included together as a secondary gas in airtight container 201. In this experiment also, the result can be comprehended as an algebraic sum the same as in the above experiments 5 and 6, and thus a drawing is provided.

From this experiment result, when water vapor and oxygen are included together as a secondary gas in a discharge space of a gas discharge panel, preferred ranges of the discharge starting voltage and the electron emission ability are satisfied if the water vapor partial pressure is 5 mPa to 20 mPa inclusive and the oxygen partial pressure is 0.2 mPa to 2 mPa inclusive.

Furthermore, when the water vapor partial pressure is 5 mPa to 10 mPa inclusive and the oxygen partial pressure is 0.5 mPa to 1.5 mPa inclusive, it has been ascertained that a gas discharge panel having most excellent characteristics is obtained.

Moreover, in the above experiments 1 to 8, the data of the discharge starting voltage and the electron emission ability is shown by a relative value referenced on a numeric value obtained when the included amount of the secondary gas approaches zero without limit. Although the above data was obtained by experimentation using the experiment device in FIG. 5, the appropriate partial pressures of the various types of secondary gas derived from the experiment results confirm the effectiveness even when design values are altered.

For reference purposes, the design values of the above experiment device were a main discharge gap of 60 μm to 100 μm, a main discharge electrode width of 100 μm to 300 μm, a barrier rib height of 110 μm to 130 μm, a gas filling pressure of 50 Pa to 70 Pa, and a sealed rare gas that is a mixed gas having an Ne base and 5% Xe.

INDUSTRIAL APPLICABILITY

A gas discharge panel and related manufacturing method that pertain to the present invention are effective in realizing the display devices of computers, televisions and so forth, and particularly in realizing high definition display devices driven at high speeds using a low drive voltage.

The invention claimed is:

1. A gas discharge panel having two substrates that face each other with a discharge space filled with a primary gas therebetween, wherein carbon dioxide having a partial pressure of 0.05 mPa to 5 mPa inclusive is present in the discharge space.

2. The gas discharge panel of claim 1, wherein carbon dioxide having a partial pressure of 0.05 mPa to 0.5 mPa inclusive is present in the discharge space.

3. The gas discharge panel of claim 1, wherein carbon dioxide having a partial pressure of 0.1 mPa to 0.2 mPa inclusive is present in the discharge space.

4. The gas discharge panel of claim 1, wherein carbon dioxide having a partial pressure of 1 mPa to 5 mPa inclusive is present in the discharge space.

5. The gas discharge panel of claim 4, wherein carbon dioxide having a partial pressure of 1.5 mPa to 3 mPa inclusive is present in the discharge space.

6. A gas discharge panel having two substrates that face each other with a discharge space filled with a primary gas therebetween, wherein water vapor having a partial pressure of 1 mPa to 10 mPa inclusive is present in the discharge space.

7. The gas discharge panel of claim 6, wherein water vapor having a partial pressure of 2 mPa to 5 mPa inclusive is present in the discharge space.

8. A gas discharge panel having two substrates that face each other with a discharge space filled with a primary gas therebetween, wherein oxygen having a partial pressure of 0.3 mPa to 5 mPa inclusive is present in the discharge space.

9. The gas discharge panel of claim 8, wherein oxygen having a partial pressure of 1 mPa to 3 mPa inclusive is present in the discharge space.

10. A gas discharge panel having two substrates that face each other with a discharge space filled with a primary gas therebetween, wherein carbon dioxide having a partial pressure of 0.5 mPa to 1 mPa inclusive and oxygen having a partial pressure of 1 mPa to 5 mPa inclusive are present in the discharge space.

11. The gas discharge panel of claim 10, wherein carbon dioxide having a partial pressure of 0.5 mPa to 1 mPa inclusive and oxygen having a partial pressure of 2 mPa to 3 mPa inclusive are present in the discharge space.

12. A gas discharge panel having two substrates that face each other with a discharge space filled with a primary gas therebetween, wherein water vapor having a partial pressure of 5 mPa to 20 mPa inclusive and nitrogen having a partial pressure of 1 Pa to 6 Pa inclusive are present in the discharge space.

13. The gas discharge panel of claim 12, wherein water vapor having a partial pressure of 2 mPa to 10 mPa inclusive and nitrogen having a partial pressure of 2 Pa to 3 Pa inclusive are present in the discharge space.

14. A gas discharge panel having two substrates that face each other with a discharge space filled with a primary gas therebetween, wherein water vapor having a partial pressure of 1 mPa to 10 mPa inclusive and carbon dioxide having a partial pressure of 0.05 mPa to 0.5 mPa inclusive are present in the discharge space.

15. The gas discharge panel of claim 14, wherein water vapor having a partial pressure of 1 mPa to 8 mPa inclusive and carbon dioxide having a partial pressure of 0.1 mPa to 0.5 mPa inclusive are present in the discharge space.

16. The gas discharge panel of claim 14, wherein water vapor having a partial pressure of 2 mPa to 5 mPa inclusive and carbon dioxide having a partial pressure of 0.1 mPa to 0.2 mPa inclusive are present in the discharge space.

17. A gas discharge panel having two substrates that face each other with a discharge space filled with a primary gas therebetween, wherein water vapor having a partial pressure of 5 mPa to 20 mPa inclusive and oxygen having a partial pressure of 0.2 mPa to 2 mPa inclusive are present in the discharge space.

18. The gas discharge panel of claim 17, wherein water vapor having a partial pressure of 5 mPa to 10 mPa inclusive and oxygen having a partial pressure of 0.5 mPa to 1.5 mPa inclusive are present in the discharge space.

19. The gas discharge panel of claim 1, further including a dielectric protective film, wherein the dielectric protective film is made from MgO having a weight density of 70% to 85% inclusive with respect to single crystal weight density.

20. The gas discharge panel of claim 19, wherein the MgO has a weight density of 70% to 80% inclusive with respect to single crystal weight density.

21. The gas discharge panel of claim 1, having a discharge area whose statistical delay time out of a discharge delay time is 100 nsecs or less during a panel drive time.

22. In an A-C type plasma display panel having two substrates with display and data electrodes that permit a write pulse and sustain pulse to provide images in an intra frame time-division graduation procedure, a dielectric protective film is provided over the electrodes with a discharge space filled with a primary gas between the substrates, the improvement comprising:

a secondary gas of carbon dioxide having a partial pressure of 0.3 mPa to 5 mPa inclusive and oxygen having a partial pressure of 1 mPa to 3 mPa inclusive are present in the discharge space with the primary gas; and the dielectric protective film includes MgO with a weight density of 70% to 85% inclusive with respect to single crystal weight density.

23. The A-C type plasma display panel of claim 22 wherein the partial pressure of the carbon-dioxide is 0.5 mPa to 1 mPa and the partial pressure of the oxygen is 2 mPa to 3 mPa.

* * * * *